66-54 SR

10/15/85 XR 4,546,623

United States Patent [19]

Kühn et al.

[11] Patent Number: 4,546,623

[45] Date of Patent: Oct. 15, 1985

[54] KNITTING MACHINE WITH CONTROLLABLY ROCKABLE KNOCK-OVER BITS

[75] Inventors: Falk Kühn, Kiebingen; Alfred Buck, Hailfingen, both of Fed. Rep. of Germany

[73] Assignee: Memminger GmbH, Freudenstadt, Fed. Rep. of Germany

[21] Appl. No.: 559,495

[22] Filed: Dec. 8, 1983

[30] Foreign Application Priority Data

Dec. 16, 1982 [DE] Fed. Rep. of Germany ..... 3246512

[51] Int. Cl.[4] ..... D04B 15/06; D04B 15/24

[52] U.S. Cl. ..... 66/104; 66/54; 66/115

[58] Field of Search ..... 66/106, 115, 222, 104

[56] References Cited

U.S. PATENT DOCUMENTS

| | | | |
|---|---|---|---|
| 1,023,312 | 4/1912 | Hirner | 66/106 X |
| 1,794,415 | 3/1931 | Mills | 66/115 |
| 2,329,617 | 9/1943 | Ingalls | 66/106 |
| 2,754,669 | 7/1956 | Lombardi | 66/222 |
| 3,855,819 | 12/1974 | Sawazaki | 66/222 X |
| 3,869,879 | 3/1975 | Brunner | 66/54 X |

FOREIGN PATENT DOCUMENTS

| | | | |
|---|---|---|---|
| 2025144 | 12/1970 | Fed. Rep. of Germany . | |
| 2425084 | 4/1975 | Fed. Rep. of Germany | 66/106 |
| 3108041 | 9/1982 | Fed. Rep. of Germany . | |
| 19814 | of 1893 | United Kingdom | 66/106 |

*Primary Examiner*—Wm. Carter Reynolds

*Attorney, Agent, or Firm*—Frishauf, Holtz, Goodman & Woodward

[57] ABSTRACT

To permit independent adjustment of movement of knock-over bit - jack sinker elements (3) having knock-over or casting-off heads (7), a cam box (22, 23) has an individually adjustable raising and lowering cam track (26, 28), engaging a butt (6) on the sinker element. The shaft (4) of the jack or sinker is formed as a double-arm lever (16, 17) with an intermediate fulcrum or pivot point projection (18), engaging a surface of the knitting machine, for example a cylinder groove, and two individual cam tracks (34, 35) are provided, formed on cam carriers (36, 37), of which, preferably, at least one (36) is adjustable, to provide for rocking movement of the knock-over bit - sinker jack element about the fulcrum or pivot projection independently of sliding longitudinal raising and lowering under control of the customarily provided cam structure (26, 28).

12 Claims, 4 Drawing Figures

KNITTING MACHINE WITH CONTROLLABLY ROCKABLE KNOCK-OVER BITS

Reference to related applications, the disclosure of which is hereby incorporated by reference, by the inventors hereof: U.S. Ser. No. 559,494, filed Dec. 8, 1983, KUHN et al "Knitting Machine with Rocking Knock-Over Bits, and Method of Knitting Therewith".

Other references: German Patent Disclosure Document DE-OS No. 31 08 041. German Patent Disclosure Document DE-OS No. 20 25 144. U.S. Pat. No. 2,090,500.

The present invention relates to knitting machines, and more particularly to knitting machines in which knitting needles are located in a needle bed, and controlled for longitudinal sliding movement; and wherein, further, knock-over bits or sinkers are located adjacent the needles and movable longitudinally with respect thereto as well as transversely in the plane of movement, the respective sliding and transverse movement of the needles and the bits being controlled by cam races.

BACKGROUND

A high-performance knitting machine in which a needle bed, typically the needle cylinder, has latch needles and knock-over bits thereon is described in German Patent Disclosure Document DE-OS No. 31 08 041. The knock-over bits are moved outwardly during the pull-in movement or retraction movement of the needles in order to facilitate sinking of the loop and thereby improving loop formation, while, additionally, improving the operation and output of the machine. The knock-over bits which, at the same time, function as sinker jacks, must carry out a composite movement. In addition to the projection and retraction movement, the knock-over bit-sinker jack elements must carry out a movement which, in the plane of projection and retraction, extends transversely to the longitudinal extent of the needles, so that the sinker nose or projection thereof can hold the knit goods during projection of the needles, while releasing the loops during sinking of the loop. The sinker nose customarily defines a sinker notch which merges into the sinker edge of the element in the head region thereof.

The longitudinal movement of the sinker jack-knock-over bit elements is customarily controlled by a jack cam which is in engagement with a suitable butt located at an end portion of the longitudinal shaft of the bit, and positioned between the respective needles. The butts are in engagement with the cam race which, in well known manner, causes relative movement with respect to the needle bed. In a circular knitting machine, this may be, for example, the needle cylinder. The transverse movement or rocking movement, can be controlled by forming a circumferentially inclined camming surface on the needle cylinder in the vicinity of the edge of the needle cylinder, the circumferential camming surface forming a bit projection cam. As the bits are projected, a control cam element on the shaft thereof will engage the cam. Consequently, the bits will be tipped or rocked outwardly as they are further projected in their projecting movement by the cam race. The entire shaft, then, will operate in the form of a single-arm lever, restrained in position by the projecting-retracting cam race and tipping about the circumferential cam on the edge of the needle cylinder. The head of the knock-over bit, located on a shaft portion beyond the circumferential cam race, will thereby be rocked in a plane parallel to the width of the knock-over bit which, normally, is in the shape of a longitudinal strip of metal.

Knitting machines of this type are particularly simple to build, and the control of the knock-over bit-jack sinker elements is simple. Yet, the inclined circumferential camming surface must be carefully made and hardened, in order to prevent excessive wear and tear thereon, and further to permit ready exchangeability of the elements of the knitting machine subject to breakage, deformation, or other malfunction. It is also difficult to control the transverse movement of the bits independently of the longitudinal movement thereof. It would be desirable to effect such control for precise control of loop formation, and do so without introducing additional complexity to the machines.

Circular knitting machines have been proposed in which transverse movement of the knock-over bits can be controlled independently of the longitudinal movement—see U.S. Pat. No. 2,090,500, and German Patent Disclosure Document DE-OS No. 20 25 144. The circular knitting machine shown in the U.S. Pat. No. 2,090,500 utilizes rocking-type knock-over bit-jack sinker combinations positioned in the dial, whereas the needles are located in the cylinder, the knock-over bits being positioned between the respective needles. Longitudinal movement of the bits is controlled by a dial cam race, positioned over the needle cylinder via positioning jacks; the rocking movement or transverse movement requires a separate cam race for the bits positioned on the dial. The manufacturing cost for such a machine is considerable and is in excess of that economically feasible for a single-bed circular knitting machine.

The circular knitting machine described in the referenced German Patent Disclosure Document DE-OS No. 20 25 144 requires special shaping and bearing arrangements for the knock-over bit-jack sinker elements and, additionally, complex camming control curves which are difficult to manufacture located on a needle cylinder, to form the bit control cam races or elements.

THE INVENTION

It is an object to provide a knitting machine in which knock-over bit-jack sinker combination elements can be independently controlled with respect to longitudinal projection-and-retraction movement as well as rocking movement, which is simple to construct, inexpensive to make, low in maintenance and repair, while operating at high speed and providing for excellent operating reliability.

In the discussion which follows, reference will be made to "transverse movement" or "rocking movement" of the knock-over bit-jack sinker elements. The longitudinal movement is the normal movement longitudinally of the shafts of the respective elements, parallel to the projection and retraction movement of the needles; the "transverse" or "rocking" movement provides for rocking in the plane of projection-retraction of the respective bits, and at an angle with respect to the projection-retraction movement.

Briefly, in accordance with the invention, the knock-over bit-jack sinker combination elements have a shaft which is formed as a double-arm lever, defining a fulcrum point at a fulcrum or pivot axis extending transversely to the shaft, and engaging a portion or zone of the needle bed. To control transverse or rocking movement, respective sinker cam races are provided, acting, respectively, on the respective arms of the two-arm lever and engaging the bit, for example via butts, and controlling, respectively, back-and-forth rocking movement of the bit elements.

The machine with the system as described has the advantage that the respective bit elements can be independently controlled for projecting and retracting movement, while forming their own fulcrum points, tipping at the fulcrum zone in which the fulcrum points, for example formed by a projection on the shaft of the bit elements, can move with the respective projecting and retracting movement. The machine construction of such an arrangement is particularly simple, and, further, permits accurate control. The entire mechanism for the knock-over bit-jack sinker elements can readily be located within the region of the needle bed without requiring additional space or complex movement transfer elements, such as slider or movement control jacks or the like. The control of longitudinal projection-and-retraction movement as well as rocking movement is independent from each other, so that the movement in the two respective directions—longitudinally and transversely—can be independently and separately controlled. The fulcrum points for the fulcrum positions of the shafts of the respective bits are not subjected to any specific or excessive wear, so that no additional manufacturing steps need be undertaken in the construction of the needle bed, and standard elements of the knitting machine.

The knitting machine can be constructed as a flat-bed machine or as a circular knitting machine. If the knitting machine is built as a flat-bed machine, the needles are carried by a longitudinal needle bed, with the knock-over bit-jack sinker combination elements located between the needles; if the machine is constructed in the form of a circular knitting machine, the needle bed can be either the cylinder and/or the dial thereof, with the knock-over bit-jack sinker elements positioned between the respective needles.

DRAWINGS

DETAILED DESCRIPTION

Figure 1:
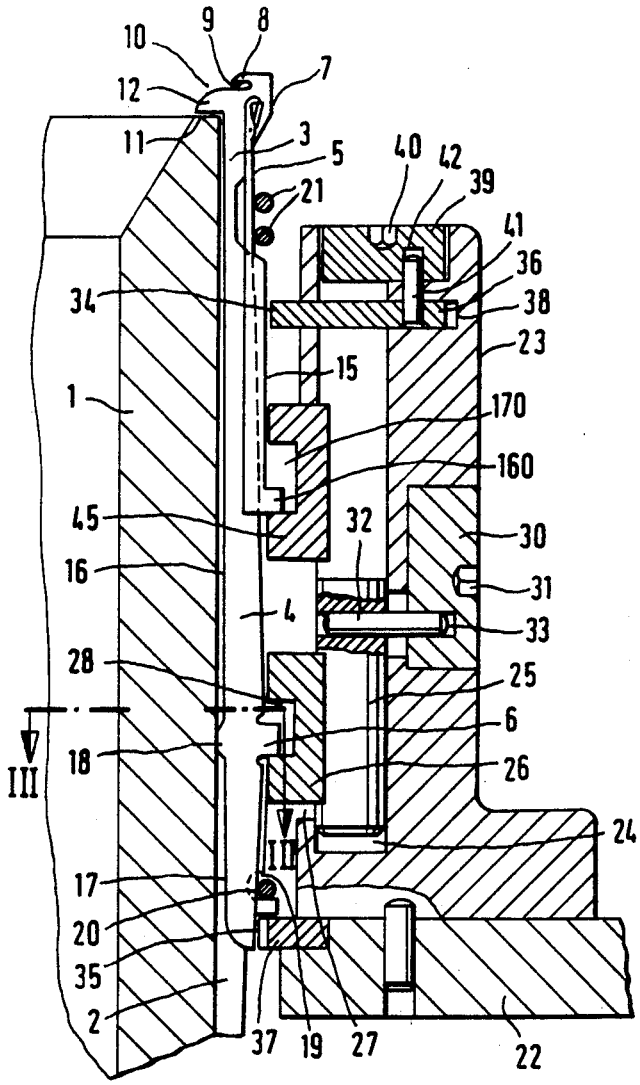
FIG. 1 is a schematic longitudinal sectional view through the needle cylinder of a circular knitting machine, and the cam race thereof, omitting all elements not necessary for an understanding of the present invention.

The cylinder 1 of a circular knitting machine—see FIG. 1—has longitudinally extending slots 2 milled therein. The knock-over bit-jack sinker combination elements 3 are longitudinally slidably located in the slots 2, and, additionally, are located therein for limited rocking movement. The elements 3 have shafts 4 which can slide and rock in the respective slots 2. Latch needles 5 are located alternately with respect to the elements 3. The latch needles 5 have butts 6 on their shafts, projecting in a direction away from the needle cylinder 1. A knock-over bit head 7 is joined to the shaft 4 of the respective elements 3. The knock-over bit heads 7 have knock-over projections or noses 8, an adjoining throat 9 and a sinker surface 10 formed on a projecting portion 12', extending beyond the edge 11 of the needle bed, in this case of the cylinder 1.

Figure 3:
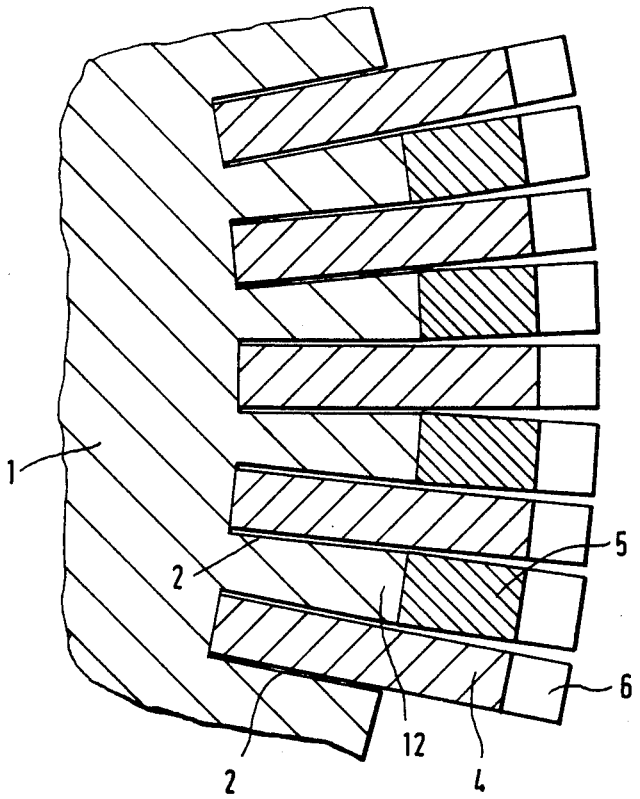
FIG. 3 is a cross section along line III—III of FIG. 1 or FIG. 2, to an enlarged scale.

As best seen in FIG. 3, each one of the bits or jacks 3 are positioned in the machine by having their respective shafts 4 located in associated slots or tricks 2 of the cylinder 1. The needles 5 are located between adjacent jacks 3 on upstanding ribs or ridges formed by surface portions 12 directly on the outer circumference of the cylinder 1. The needles are longitudinally movable independently longitudinally movable of the jacks 3. The needles 5, thus, are longitudinally guided by the respective jacks 3 at both lateral sides. A predetermined play is provided, determined on the cylinder of a circular knitting machine by the rounding of the needle cylinder. This improves easy longitudinal sliding, without interfering with accuracy of stitch formation.

Figure 4:
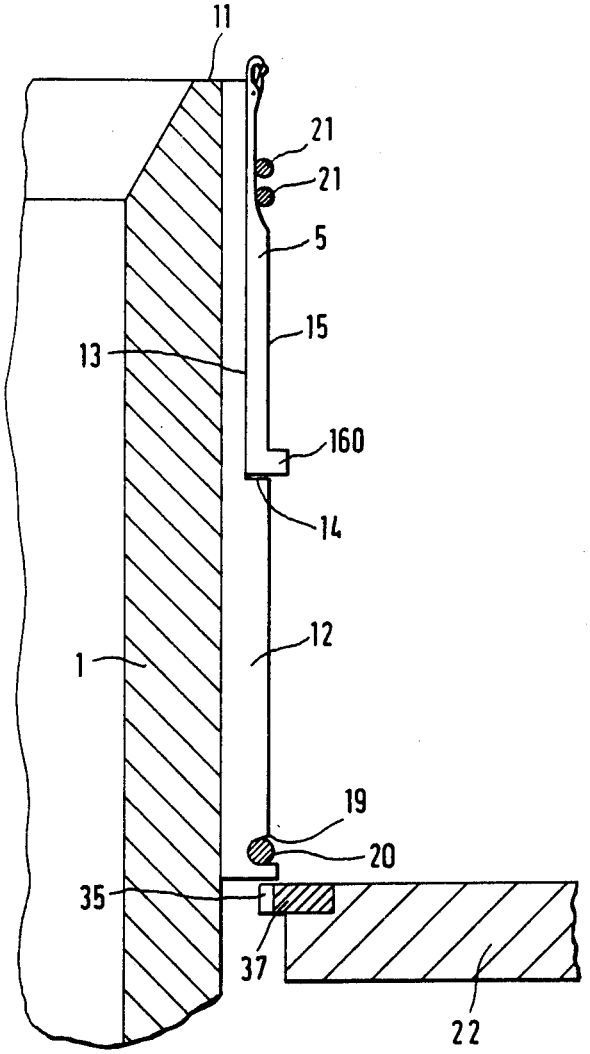
FIG. 4 is a simplified longitudinal part-sectional side view of the needle cylinder of FIG. 1.

The upstanding ribs or ridges 12 may be formed—see FIG. 4—with a recess 13, in the bottom of which the respective latch needles 5 are positioned, and defining a shoulder 14 which forms a bottom abuttment for the respective needles 5, and defining the base or "home" or knock-over position of the needle 5.

Each latch needle has a control butt 160 formed at the bottom of the shaft 15 thereof—see FIGS. 1, 4—which engages in associated cam groove 170. The raising and lowering movement of the needle is obtained, as well known, by relative rotation between the needle cylinder 1 and the cam elements defining the cam groove 170.

The shaft 4 of each one of the jacks or bits 3 is constructed in form of a double-arm lever having two lever arms 16, 17. The two lever arms 16, 17 on the shaft 4 are separated by a fulcrum projection 18. The fulcrum projection 18, in plan view as seen in FIG. 1, is approximately triangular, and positioned on at least approximately the same level as an oppositely projecting butt 6. The fulcrum projection 18 engages the bottom wall of the associated trick or slot 2 of the needle bed or carrier 1.

The ridges 12 of the needle cylinder 1 are formed with a recess 19, shaped as a circumferential groove, and providing space for an endless circumferential spring 20, engaging against and seated on the lower lever arms 17 of the bits or jacks 3. The circumferential spring 20 elastically biasses the bits or jacks 3 into an end or terminal position shown in FIG. 2, in which the head 7 is radially lifted off the cylinder 1, and thus permits release of the stitch which previously had been held in the throat 9 by the projecting nose 8 of the bit or jack 3. The circumferential spring 20 also retains the respective bits or jacks 3 together when the cams and cam races are removed which, for example, is done for purposes of maintenance, changing the set-up of the machine, or the like; the cams, constructed in the form of customary cam locks, can be removed as desired, in segmental portions. The spring, additionally, forms an abutment and counter guidance element for the bits or sinker jacks 3 when the sinker jacks 3 are to be controlled for radially inward motion, to be described below.

The shoulder 14 on the ribs 12 is provided to facilitate exchange of needles and cam segments, for example upon replacement of needles, or exchange of a needle set, thereby facilitating engagement of the respective cam races with the needle butts, needle replacement and the like.

The needles 5 are maintained in position by two circumferential springs 21, and biassing the needles 5 towards the ribs or ridges 12, so that the shafts 15 engage the ribs or ridges 12. The circumferential springs 21 are endless springs which extend circumferentially about the needle cylinder 1.

The needle cylinder 1 is surrounded by a structural ring 22 on which the cam holder 23 is secured. The cam holder 23 is segmental, and formed of a plurality of rings. The cam holder 23 carries the respective cams, segmentally arranged thereon and associated with the respective feeds of the circular knitting machine, as well known and in accordance with any suitable and standard construction, secured thereto for easy exchange and maintenance, as well known. The segment of the cam 23 shown in longitudinal section in FIG. 1 is formed with a bore or opening 24, extending parallel to the cylinder 1 on which a bolt 25 is longitudinally slidable secured. The bolt 25 carries the actual cam elements 26 which project outwardly through an opening 27 in the cam holder 23. The cam element 26 carries the knock-over bit or jack-sinker cam 28, engaging with the butts 6 of the bit-jack elements and controlling raising and lowering is formed by a slidable connection between the bolt 25 and an externally accessible adjustment disk 30, formed with a tool engaging recess 31, for example adapted to receive an Allen head wrench. The pin-slit connection is formed by a pin 32 engaging the bolt 25 and located within a spiral control groove 33 on the inside of the disk 30. By rotation of the disk 30, bolt 25 and hence the knock-over bit-jack sinker cam elements 26 are raised or lowered, thereby changing the raised or projected and lowered or retracted position of the knock-over bit-jack sinker elements 3.

The rocking movement of the knock-over bit-jack sinker elements 3 is controlled by jack cam curve surfaces 34, 35. The surface 34 is formed at the outer end surface of a slider 36. The control cam surface 35 is formed on a cam element 37. The two control curve surfaces 34, 35 control the transverse or rocking or pivoting movement of the head 7 of the knock-over bit. The upper control surface 34 moves the bit 3 towards the holding position, that is, towards the needle cylinder 1. The cam surface 35 controls the elements 3 away from the holding position, that is, away from the needle cylinder 1. Movement, in each instance, is transverse to the longitudinal direction of the latch needles 5.

The slider 36 is located in a groove or slot 38 of the cam structure 23, slidable transversely to the axis of the needle cylinder. It can be adjusted radially by an adjustment arrangement which is similar to the vertical adjustment of the bolt 25, and formed by a disk 39, fitted in the element 23. The disk 39 is formed with a tool-engaging recess 40, and connected via a pin-slot connection 41, 42 with the slider 36, similar to the pin-slot connection 32, 33, previously described.

It would, of course, also be feasible to apply the control surface 35 on a movable or slidable element similar to the slider 36 to permit radial positioning of the control surface 35. Such a connection could be made, for example, by connecting the cam element 37 to a threaded spindle to move the cam 37 more or less towards and away from the cylinder 1 by rotation of an externally accessible screw slot.

The cam holder 23 retains additionally the needle control cams, that is, the respectively ascending, descending and blocking cams for the needle 5, as is customary. The needle control cam is shown only schematically at 45, and any suitable and standard construction may be used.

OPERATION

In a circular knitting machine, the cylinder 1 and the cam holder 23 move relatively. Upon such relative movement, the needles 5 are projected and retracted, or raised and lowered, in accordance with the camming arrangement of cam 45. In addition to movement of the needles, the knock-over bit-jack sinker elements 3 are raised and lowered, or projected and retracted, in a movement which is independent of the movement of the needles, and may be in the same direction, or counter the direction of needle movement, as desired. In addition, the elements 3 are subjected to transverse or rocking movement. Control of longitudinal movement of the elements 3 is obtained—as described—by the cam element 26 defining the raising and lowering, and or projecting and retracting positions of the elements 3. Entirely independently of the longitudinal raising and lowering movement, the elements 3 can be subjected to a limited tipping or rocking movement about the fulcrum 18 under control of the respective rocking cam surfaces 34, 35. At least one of those cam surfaces—in the illustration cam surface 34—should be adjustable independently of the position of the jack cam 26.

Figure 2:
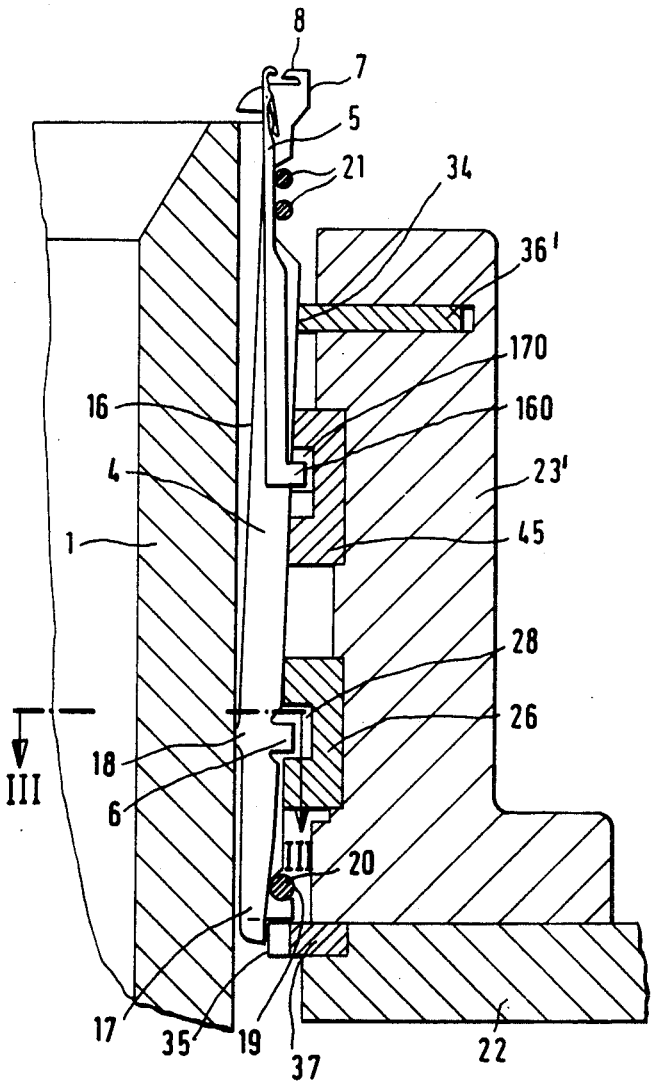
FIG. 2 is a view similar to FIG. 1, and illustrating another embodiment.

FIG. 1 illustrates the thread holding position of the elements 3, as well as the base or knock-over position of the respective associated needle 5. FIG. 2 illustrates a simplified embodiment in which the knock-over bit-jack sinker cam 26 is fixed, and non-adjustable in the cam holder 23', and in which, further, the slider 36' is held non-adjustably in fixed position. FIG. 2 illustrates a different position of the respective movable elements, namely the elements 3 in the projected or raised position in which the stitches are released; the latch needle 5 is shown in the yarn or thread laying-in or thread placement position. Of course, the construction of FIG. 2 could be readily modified by replacing slider 36' by slider 36 (FIG. 1) and/or making the cam carrier 37 adjustable as previously described.

The fulcrum point for the elements 3 can be formed in various ways, and preferably, as described, by a suitable projection 18. The projection 18, as shown, is formed preferably as an essentially triangular or trapezoidal projection, which may, additionally, be rounded; a particularly suitable arrangement is the approximately triangular shape, as shown. In accordance with a feature of the invention, the projection is located on the side away from the raising and lowering butt 6 of the shaft 4 of the elements 3. This permits small dimensions for the lower shaft portion of the element 3 since the rocking movement of the associated shaft will not cause escape of the butt 6 from the associated cam race 28 of cam 26 during longitudinal movement of the element 3.

The spring 20 provides for elastically biassing the elements 3 into the stitch-release position after having been tilted by the cam surface 34 into the stitch occlusion position. The elastic spring 20 also has the additional function to insure reliable engagement of the shafts of the elements 3 on the respective cam surfaces 34, 35 while permitting longitudinal movement, in the direction of the shaft 4, at all times. The spring 20 can be any suitable spring element; in a circular knitting machine it is, preferably, an endless circular spring, although other arrangements providing for the biassing force may be used, for example spring elements positioned on the cam carrier 23 and acting radially, for example by means of an intervening pusher, on the elements 3. The spring or a pusher element, regardless of how formed, is preferably secured in position on the shafts 4 of the elements 3 and/or on the needle bed, for example on the needle cylinder, and/or on the element 23.

Particularly simple arrangement of the respective parts of the structure is obtained by placing the two control curves 34, 35 on respectively separate elements 36, 37 which are located, spaced apart, on the cam carrier 23, or on the holder bed 22 therefor. In accordance with a preferred embodiment, at least one of the cam carriers—in the embodiment shown in FIG. 1 the cam carrier 36—is adjustably positioned so that the rocking movement of the elements 3 can be suitably controlled and adjusted with respect to the longitudinal movement thereof and the movement of the needles 5. The arrangement as described in connection with FIG. 1 is particularly simple, and hence preferred, in which the longitudinal movement is controlled by individual raising and lowering cams for the elements 3, and the rocking movement by at least one individually controllable slider. In accordance with a preferred feature of the invention, the longitudinal raising and lowering cams, or projecting and retracting position of the elements 3 in the direction of raising and lowering of the needles, is preferably adjustable, so that the maximum extent of ascent and descent of the elements 3 can be suitably matched to the raising and lowering movement of the needles 5. The longitudinal adjustment arrangement 30–33 described in connection with FIG. 1 is particularly simple.

The arrangement has the additional advantage that the needle cam carrier 45, carrying the needle cam race 170, can be located on the same structural element which also carries the raising and lowering cams for the knock-over bits 3 as well as the rocking cam elements 36, 37 therefor. This construction, therefore, eliminates the necessity for separate structural holder elements.

The needles are guided, longitudinally, between the shafts 4 of the knock-over bits or jacks, so that separate tricks for the needles need not be used. The shafts 4 of the elements 3, themselves, define therebetween suitable slots which form the tricks for the needles. The ridges which, therebetween, form the tricks for the shafts 4 of the knock-over bits 3 are, preferably, stepped to form the shoulder 14 (FIG. 4) to provide a predetermined defined base position for the needles, thus facilitating needle replacement and exchange.

Various changes and modifications may be made, and any feature described in connection with any one of the embodiments may be used with any other feature, within the scope of the inventive concept.

We claim:

1. Knitting machine having at least one needle carrier (1);

a plurality of knitting needles (5) located, spaced from each other, on the needle carrier, and movable thereon;

a needle cam race (45, 170) controlling movement of the needles (5);

a plurality of knock-over bit-jack sinker elements (3), each having a shaft (4), a knock-over head and a butt (6) projecting laterally from the shaft (4), the knock-over bit-jack sinker elements being inserted between the needles, the knock-over bit-jack sinker elements (3) being slidable independently of movement of the needles between the needles and, additionally, being positioned for movement of the jack heads (7) transverse to the movement of the needles in the plane of sliding movement of the elements (3);

and individual cam means for controlling, independently, longitudinal movement of the elements and transverse movement of the element heads (7), including a cam structure (26) defining a cam race (28) engaged by the butts of the knock-over bit-jack sinker elements (3) and controlling longitudinal movement of said elements, and camming elements (36, 37) controlling transverse movement of said knock-over bit-jack sinker elements, said cam structure (26) and said camming elements (36, 37) being supported by said cam carrier structure (22, 23), wherein each shaft (4) of the knock-over bit-jack sinker elements (3) is formed as a double-arm lever (16, 17), having a fulcrum or pivot point (18) intermediate the length of the shaft (4) of the element (3) and defining the lever arms (16, 17) on either side of said fulcrum or pivot point, said fulcrum or pivot point (18) comprises a projection extending laterally from the shaft (4) of each of the elements and in a direction opposite that of the butt (6), the projection (18) defining the pivot or fulcrum point, and the butt being located on at least approximately the same level as the pivot point, with respect to the longitudinal extent of the shaft (4), of the respective knock-over bit-jack sinker elements, the fulcrum or pivot point being supported on the needle carrier (1) and permitting rocking of the shaft (3) of said element about an axis transverse to the longitudinal extent of the element;

and wherein the camming elements (36, 36', 37) for controlling transverse or rocking movement comprises cam surfaces (34, 35) acting, respectively, on the two arms (16, 17) of the double-arm lever, the cam surfaces controlling, respectively, rocking or pivoting movement of said elements about said fulcrum or pivot point (18) and hence transverse movement of the element heads (7) in respectively opposite direction while permitting longitudinal slidable movement of said elements independently of said rocking or pivoting movement, and independently of movement of the needles under control of the needle cam race (45);

said cam structure (26) defining the cam race (28) being located intermediate the camming elements (36, 37) and being supported by the cam carrier structure for longitudinal adjustable movement with respect to the cam carrier structure.

2. Knitting machine according to claim 1, further including force bias means (20) engaging at least one (17) of the lever arms (16, 17) are resiliently biassing the respective element into one terminal position of the movement of the heads (7) transverse to the movement of the needles.

3. Knitting machine according to claim 2, wherein the knitting machine is a circular knitting machine;

and the resilient force biassing means (20) comprises an endless circular spring (20) engaging one (17) of said lever arms;

the machine comprises guide means (12) for locating and retaining said knock-over bit-jack sinker elements (3) in the machine essentially parallel to each other;

and means (19) for retaining said circular spring (20) in position in the machine.

4. Knitting machine according to claim 1, wherein the cam carrier structure is positioned on the machine facing the needles; and said camming elements (36, 37) are located on the cam carrier structure when said camming surfaces (34, 35) facing the needles and hence said knock-over bit-jack elements (3).

5. Knitting machine according to claim 4, including means (39, 40, 41) for adjustably securing said one camming element (36) to the cam carrier structure, said means comprising an externally adjustable positioning element (39) and coupling means (41, 42) coupling said externally accessible positioning element to said one camming element (36).

6. Knitting machine according to claim 1, further including externally accessible adjustment means (30–33) engaging said cam structure (26) for longitudinally positioning the cam structure, in selected adjusted position, on the cam carrier structure (22, 23).

7. Knitting machine according to claim 6, wherein said externally accessible adjustment means comprises a rotatable positioning element (30);

and a pin-and-slit connection (32, 33) coupling the rotatable positioning element to the cam structure.

8. Knitting machine according to claim 5, wherein the externally accessible positioning element comprises a rotatable positioning element (39);

and a pin-and-slit connection (41, 42) coupling the rotatable positioning element to the cam structure.

9. Knitting machine according to claim 1, wherein the needle carrier comprises a needle bed (1) formed with slots or tricks (2);

and wherein the jack shafts (4) are located within said slots or tricks for longitudinal movement and lateral guidance therein.

10. Knitting machine according to claim 9, wherein said slots or tricks define therebetween upstanding ribs (12);

and wherein the needles (5) have needle shafts (15) located on said ribs (12) between the slots or tricks.

11. Knitting machine according to claim 10, wherein said ribs (12) are each formed with an abutment surface (14) to define a base position for the needles (5).

12. Knitting machine according to claim 9, wherein said projections defining the fulcrum or pivot point (18) engage the inner surface of said slots or tricks (2) to permit longitudinal sliding movement of the shafts (4) of said elements (3) while, additionally, permitting rocking movement of said elements about said pivot or fulcrum point projection (18) regardless and independently of the longitudinal position of said elements (3) in said slots or tricks by surface engagement of said projections (18) with the inner wall surface of the slots or tricks.

* * * * *